US007731560B2

(12) United States Patent
Kratz

(10) Patent No.: US 7,731,560 B2
(45) Date of Patent: Jun. 8, 2010

(54) MOTORIZED INTERACTIVE FIGURE

(75) Inventor: Ryan Kratz, Oak Park, IL (US)

(73) Assignee: Rehco, LLC, Chicago, IL (US)

( * ) Notice: Subject to any disclaimer, the term of this patent is extended or adjusted under 35 U.S.C. 154(b) by 346 days.

(21) Appl. No.: 11/756,054

(22) Filed: May 31, 2007

(65) Prior Publication Data

US 2008/0020670 A1 Jan. 24, 2008

Related U.S. Application Data

(60) Provisional application No. 60/803,737, filed on Jun. 2, 2006.

(51) Int. Cl.
*A63H 13/04* (2006.01)
*A63H 29/22* (2006.01)

(52) U.S. Cl. ..... 446/354; 446/357; 446/377; 446/484

(58) Field of Classification Search ..... 466/330, 466/332–335, 354–357, 376, 377, 484
See application file for complete search history.

(56) References Cited

U.S. PATENT DOCUMENTS 3,721,040 A * 3/1973 Goldfarb ..... 446/354
4,775,351 A * 10/1988 Provenzano, Jr. ..... 446/175
5,056,249 A * 10/1991 Sakurai ..... 40/414
5,273,479 A * 12/1993 Chang ..... 446/272
5,601,471 A * 2/1997 Kennedy ..... 446/236
6,022,263 A * 2/2000 Liu et al. ..... 446/379
6,042,451 A * 3/2000 Feldman ..... 446/330
6,093,078 A * 7/2000 Cook ..... 446/354
6,126,508 A * 10/2000 Chou ..... 446/358
6,149,491 A * 11/2000 Arad et al. ..... 446/355
6,163,992 A * 12/2000 Chou ..... 40/411
6,200,191 B1 * 3/2001 Chou ..... 446/353
6,244,925 B1 * 6/2001 Chou ..... 446/354
6,579,143 B1 * 6/2003 Rehkemper et al. ..... 446/330
6,652,351 B1 * 11/2003 Rehkemper et al. ..... 446/354

* cited by examiner

*Primary Examiner*—Kien T Nguyen
(74) *Attorney, Agent, or Firm*—Adam K. Sacharoff; Much Shelist

(57) ABSTRACT

The present invention provides for an interactive figure with a head, body and waist cavities, arms, legs and two motorized wheelbases. The body and waist cavities include a gear mechanism. The motorized wheelbases control the movements of the interactive figure via a relationship between the gear mechanism and motors housed within the motorized wheelbases by distributing power to the motors based on a user's input or a preprogrammed response.

6 Claims, 7 Drawing Sheets

DETAIL A
SCALE 1 : 1
DETAIL B
SCALE 1 : 1
A
B
18
28
26
34
32
36
30
40
42
20
50
14
44
48
24
58
60
62
22
68
51
49

12
14
16
30
36
49
51
22
24
28
61
62

12
20
30
36
14
16
51
49
22
24
62
61

MOTORIZED INTERACTIVE FIGURE

CROSS REFERENCE TO RELATED APPLICATIONS

This application claims priority to provisional application Ser. No. 60/803,737 filed Jun. 2, 2006.

FIELD OF THE INVENTION

The present invention relates to an motorized interactive figure including electronically controlled mechanical movements.

BACKGROUND OF THE INVENTION

Toy dancing figures are well known in the art and have employed many various aesthetic novelty designs, from flowers (U.S. Pat. No. 5,056,249) and soda cans to fish (U.S. Pat. No. 4,775,351). However, these lack the innovation to create complex animated movements needed for dolls and for various other standing figures. While the prior art is not devoid of dancing dolls, toys or other figures, there are disadvantages in the prior art and areas that need improvement. For instance, one disadvantage exists in animated figures that are fixed on a base in order to provide stability, lacking a more lifelike appearance that free-standing figures provide. These non-free standing figures typically include the mechanisms that create or control the movements of the figure in the base and are often comprised of moveable rods that travel through the legs. These dancing toys may be represented in U.S. Pat. Nos. 6,163,992; 6,126,508; 5,601,471; and 5,273,479. Other non-free standing figures incorporate the mechanisms in the upper or lower torso, but since this type of arrangement causes the figure to be top-heavy, the figures rely on the base to keep the figures upright. For example, U.S. Pat. No. 6,261,148 discloses a twisting figure; U.S. Pat. No. 6,071,170 discloses a figure that vibrates and moves side to side; and U.S. Pat. No. 5,735,726 illustrates an animated figure that stands and sits.

While free-standing animated dolls are present in the art, these dolls similarly place the mechanisms in the torso, which as mentioned above may cause instability. To compensate for this the dolls typically reduce the speed or rate of animation and movement the dolls produce. As such these dolls typically only walk, illustrated in U.S. Pat. No. 5,820,441; tap dance, disclosed in U.S. Pat. No. 5,147,238; or sway from one side to another, shown in U.S. Pat. No. 5,911,617. Another interesting disclosure is found in U.S. Pat. No. 5,176,560, which discloses a free-standing dancing doll. However, the mechanism that powers the movement is situated in the torso of the doll, which as mentioned above may limit the speed of the movements in order to keep the toy upright.

As such there exists a need to improve upon the prior art without the disadvantages outlined above. In addition thereto, typical dancing figures and toys animate in response to detecting music or sound, while others may be simply animated at the same time the figure plays music providing the appearance that the figure is dancing. As such a further improvement over the prior art would include the ability to control the animation of the figure.

SUMMARY OF THE INVENTION

In one embodiment of the present invention there is provided a motorized interactive figure includes a lower torso bevel gear assembly and an upper torso bevel gear assembly. The lower torso bevel gear assembly is defined as having a lower body bevel gear meshed to a lower left bevel gear and meshed to a lower right bevel gear. A left leg being mechanically linked to the lower left bevel gear and a right leg being mechanically linked to the lower right bevel gear, wherein movement of either the left leg or right leg moves the right leg or left leg respectively in an opposite direction. A motorized wheelbase is connected to the end of each of the legs and each motorized wheelbase contains a motor mechanism for driving at least one set of wheels. A processor that facilitates an operation of programs and access of data and content stored on a memory. In addition the ability to control the motor mechanisms based on preprogrammed signals, input signals, and/or audio content is provided.

The upper torso bevel gear assembly has an upper body bevel gear meshed to an upper left bevel gear and meshed to an upper right bevel gear. A body axle is provided that is secured on one end to the lower body bevel gear defined in the lower torso bevel gear assembly and secured to the other end of the upper body bevel gear, such that rotation of the lower body bevel gear causes rotating of the upper right bevel gear and visa versa. A left arm is mechanically linked to the upper left bevel gear and a right arm is mechanically linked to the upper right bevel gear, wherein movement of upper body bevel gear causes movement in the left and right arms.

Numerous other advantages and features of the invention will become readily apparent from the following detailed description of the invention and the embodiments thereof, from the claims, and from the accompanying drawings.

BRIEF DESCRIPTION OF THE DRAWINGS

A fuller understanding of the foregoing may be had by reference to the accompanying drawings, wherein.

DETAILED DESCRIPTION OF THE EMBODIMENTS

Figure 1B:
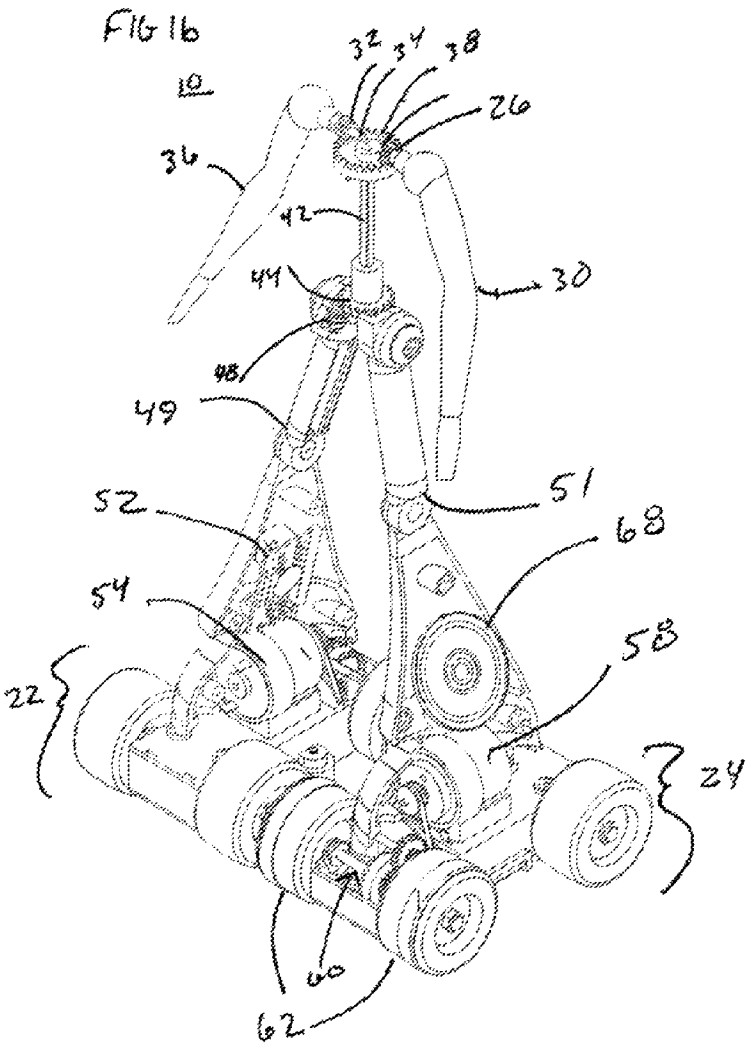
FIG. 1*b* is a front perspective view of the internal components of a figure in accordance with an embodiment for an interactive figure.

While the invention is susceptible to embodiments in many different forms, there are shown in the drawings and will be described herein, in detail, the preferred embodiments of the present invention. It should be understood, however, that the present disclosure is to be considered an exemplification of the principles of the invention and is not intended to limit the spirit or scope of the invention and/or embodiments illustrated.

Figure 1A:
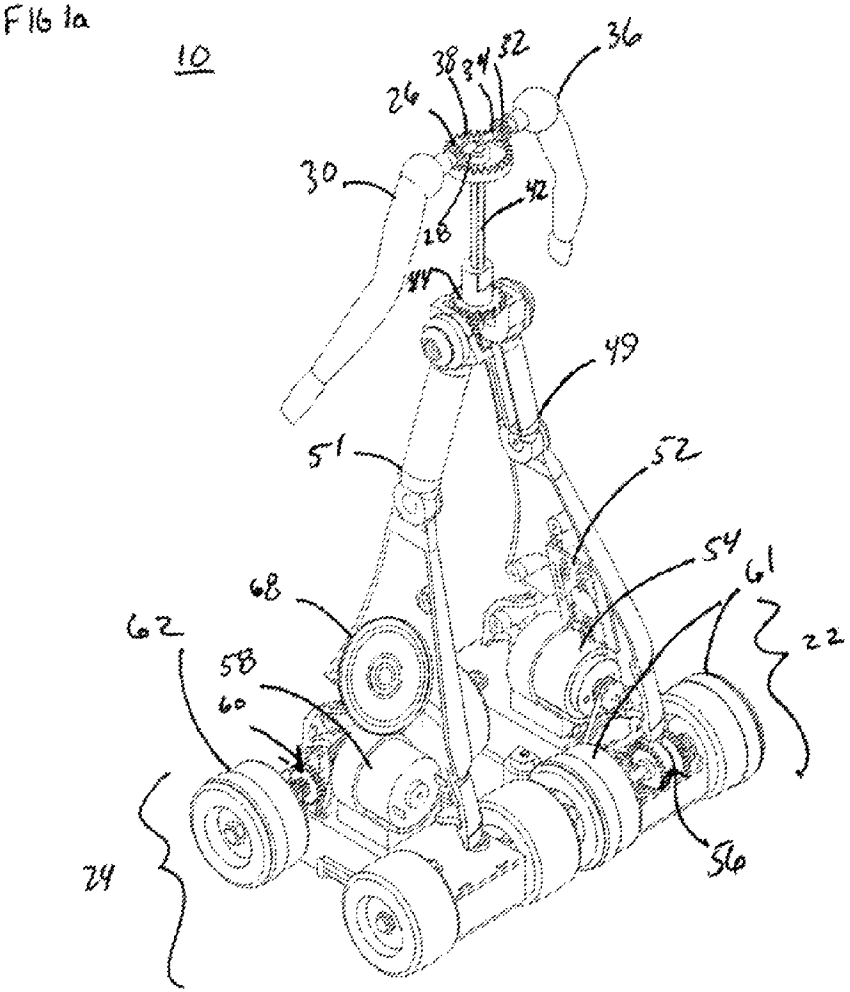
FIG. 1*a* is a rear perspective view of the internal components of a figure in accordance with an embodiment for an interactive figure.
Figure 1C:
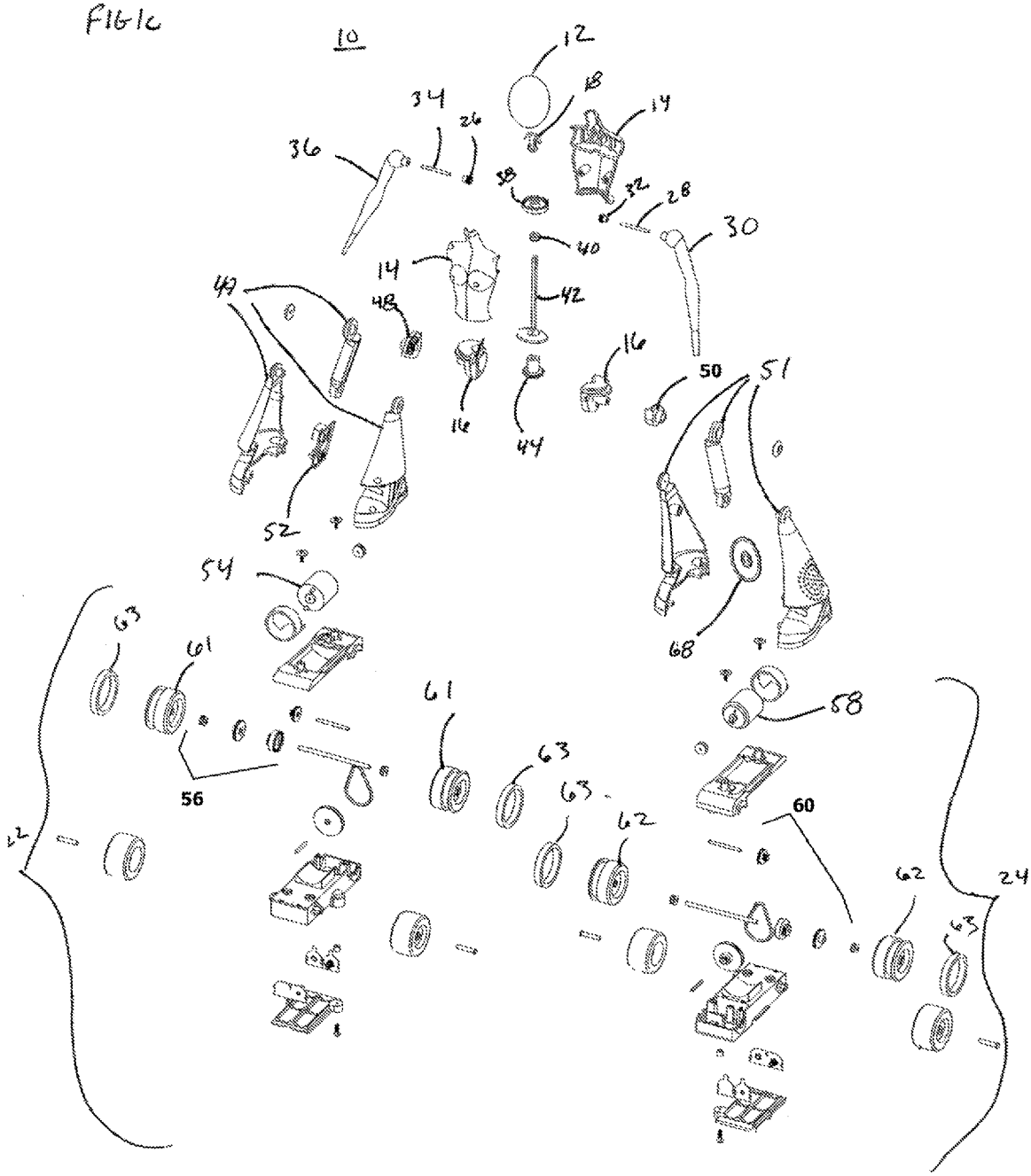
FIG. 1*c* is an exploded view of an interactive figure.

Referring now to FIGS. 1*a*-1*c*, in accordance to a first embodiment, there is illustrated an interactive figure 10. The size, shape, or styling of the interactive figure 10 is not critical to the present invention. As such, virtually any figure, doll, or character may be used without deviating from the spirit of the invention as the outside appearance of interactive figure 10 is not meant to limit the scope of the invention.

Figure 2B:
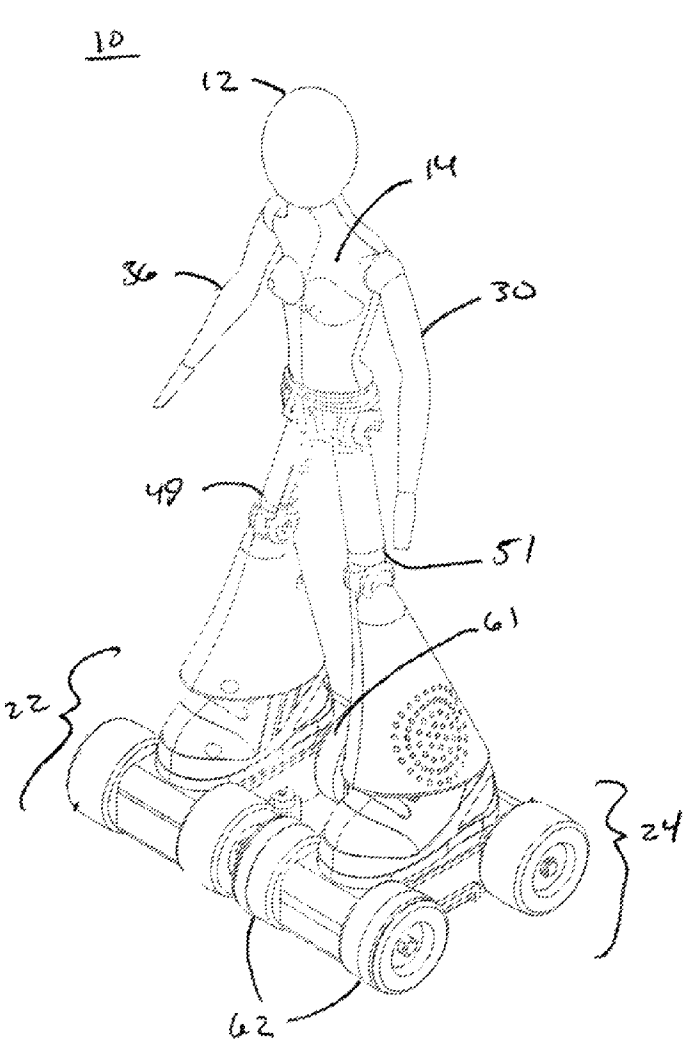
FIG. 2*b* is a front perspective view of the figure from FIG. 1*b* where the exterior surfaces of the figure are included.
Figure 2A:
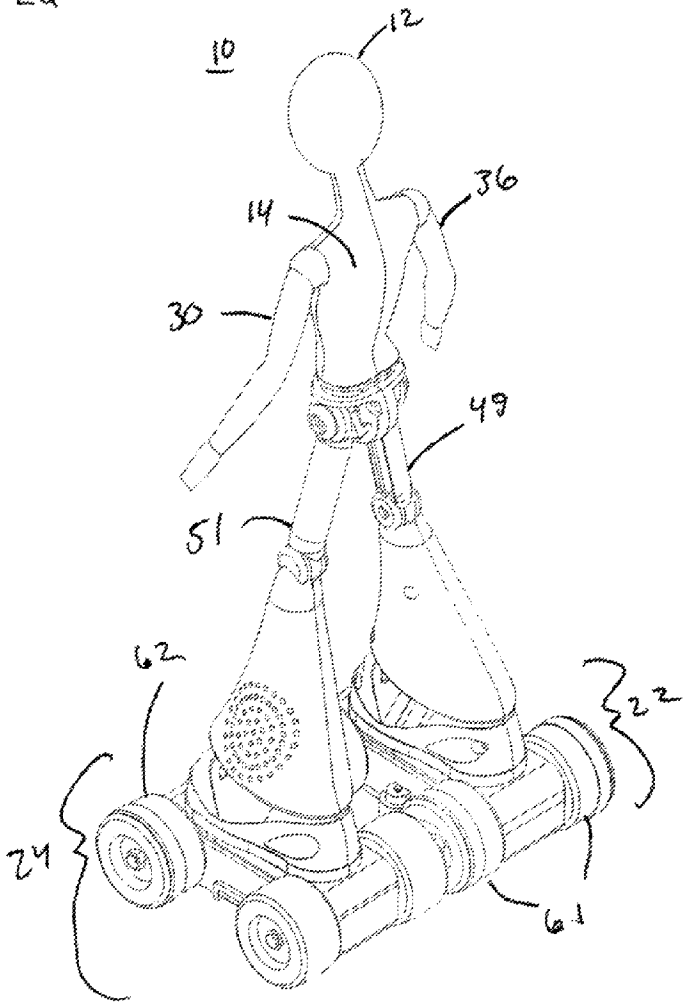
FIG. 2*a* is a rear perspective view of the figure from FIG. 1*a* where the exterior surfaces of the figure are included.

The interactive figure 10 contains components including a head 12, a body cavity 14, a waist cavity 16, two arms, two legs, and two motorized wheelbases. These components interact based on a user's input or preprogrammed response to move the interactive figure 10 in a variety of different movements (as described below). The motorized wheelbases may have other forms or may have more or less wheels then that which is illustrated herein. For example and as illustrated in FIGS. 2*a* and 2*b*, the motorized wheelbases may be in the form of a roller skate however, the wheelbases may only have two wheels and be formed as an in-line skate.

As illustrated in FIGS. 1*a*-1*c* and FIGS. 3*a*-3*c*, the head 12 is secured to a head pivot 18 included in the body cavity 14. The head pivot 18 permits the head 12 to move from side to side freely. Housed within the body cavity 14 and waist cavity 16 is a gear mechanism 20 that enables movement of various components of the figure 10 and is driven by a right motorized wheelbase 22 and a left motorized wheelbase 24. Both motorized wheelbases are controlled by a user's input or a preprogrammed response (as explained below).

Figures 3A, 3B, 3C:
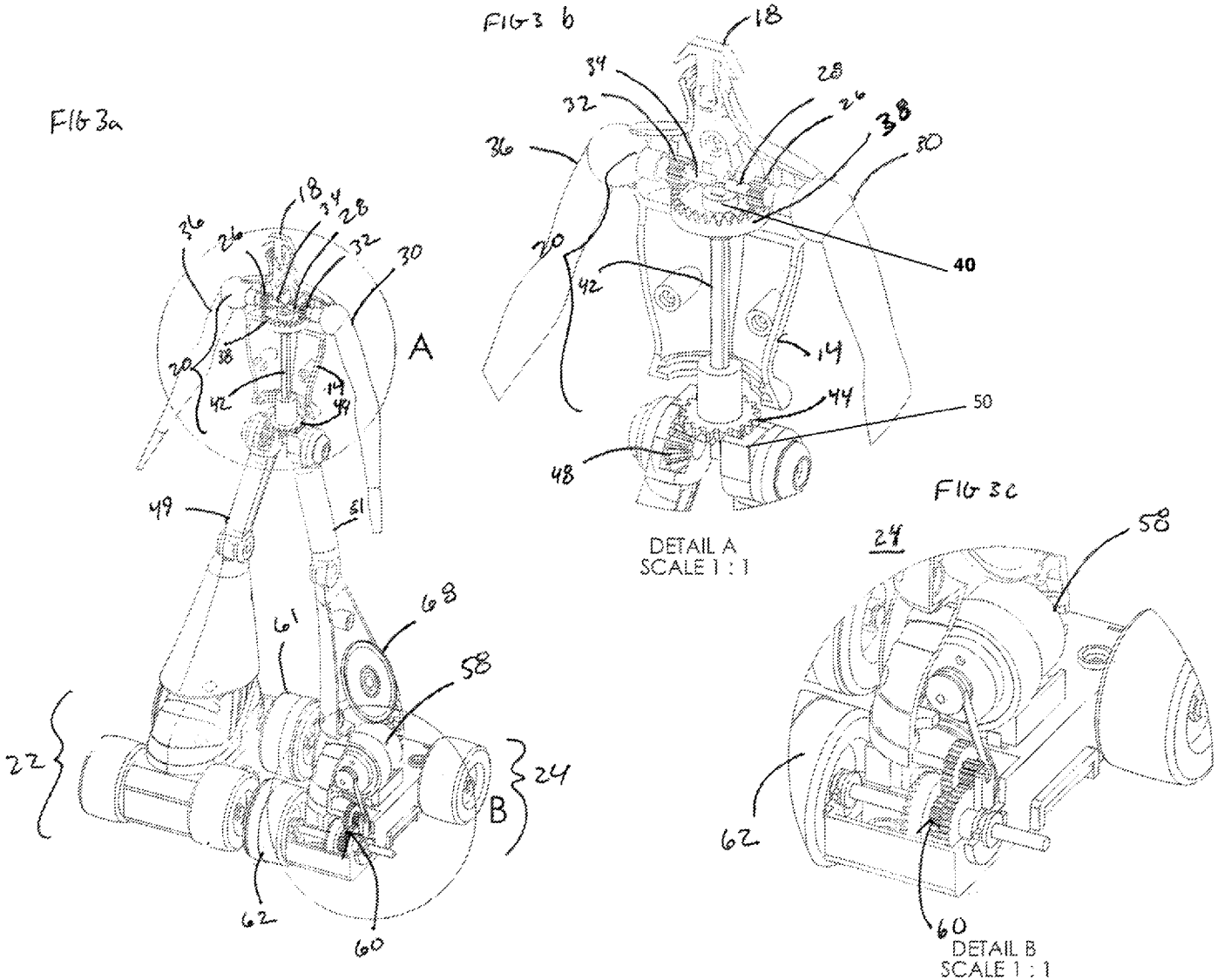
FIG. 3*a* is a front perspective view of the internal components of a figure that illustrates a gear mechanism housed within a figure in accordance with an embodiment for an interactive figure.
FIG. 3*b* is a detailed front perspective view of the figure from FIG. 3*a* illustrating the components of a gear mechanism.
FIG. 3*c* is a detailed front perspective view of the figure from FIG. 3*a* illustrating the components of a motorized wheelbase.

Continuing to refer to FIGS. 3*a*-3*c*, the gear mechanism 20 provides for several movements to occur simultaneously by linking the moving body parts. The gear mechanism 20 includes a left shoulder pinion 26 secured to a left shoulder axle 28 that is secured to a left arm 30. Further, the gear mechanism 20 includes a right shoulder pinion 32 secured to a right shoulder axle 34 that is secured to a right arm 36. Both the left shoulder pinion 26 and the right shoulder pinion 32 are meshed to a crown gear 38, enabling the two arms to move at the same time. When the crown gear 38 moves, the right shoulder pinion 32 and left shoulder pinion 26 move directing the right arm 36 and left arm 30 to move. In one embodiment the right arm 36 moves either up or down, while the left arm 30 moves in the opposite direction. However, it is contemplated that the arms may move in the same direction.

The crown gear 38 is secured to a body bushing 40 that is secured to a body axle 42. A body bevel gear 44 housed within the waist cavity 16 is secured at the base of the body axle 42 such that the crown gear 38 and body axle 42 move in sync with the body bevel gear 44. Thus, the body axle 42 transfers movement to the crown gear 38 from the body bevel gear 44. The body bevel gear 44 meshes with a right bevel gear 48 and a left bevel gear 50. The right bevel gear 48 is secured to a right leg 49, which is secured to the right motorized wheelbase 22. The left bevel gear 50 is secured to a left leg 51, which is secured to the left motorized wheelbase 24. The positioning of the speaker 68 within interactive figure 10 is not critical to the present invention.

Each of the motorized wheelbases includes a motor, a power source, a gear train and at least one set of powered wheels. These components combine to provide for two-wheel drive powered movement. An integrated circuit (IC) (described below) directs the motors to move the interactive figure 10. The right motorized wheelbase 22 includes a first motor 54 that drives the right gear train 56 and a set of right powered wheels 61. Referring to FIG. 1*c*, the left motorized wheelbase 24 includes a second motor 58 that drives the left gear train 60 and a set of left powered wheels 62. For stability purposes each motorized wheelbase includes a pair of wheels 67 freely rotatably attached to a front axle 69

The IC has the capability to drive both motorized wheelbases in the forward and reverse directions in accordance with a user's input or a preprogrammed response. The components needed to facilitate this two-wheel drive powered movement are widely available and known in the art, such that further reference is not needed. In addition, rings 63 may be secured on the wheels to adjust the performance of the interactive figure 10. For example, the rings 63 can be made from a rubber material that would alter the frictional relationship between the wheels and a surface to provide improved grip.

The first embodiment includes a means to control the movement of the interactive FIG. 10 through the selective distribution of power to the motorized wheelbases and based on preprogrammed signals, a user's input signals, and/or audio content. In one embodiment, the invention utilizes a controller (not shown) and the two motorized wheelbases to control the movement of the interactive figure 10 through the selective distribution of power based on a user's input to the controller and described in further detail below.

Figures 4A, 4B, 4C:
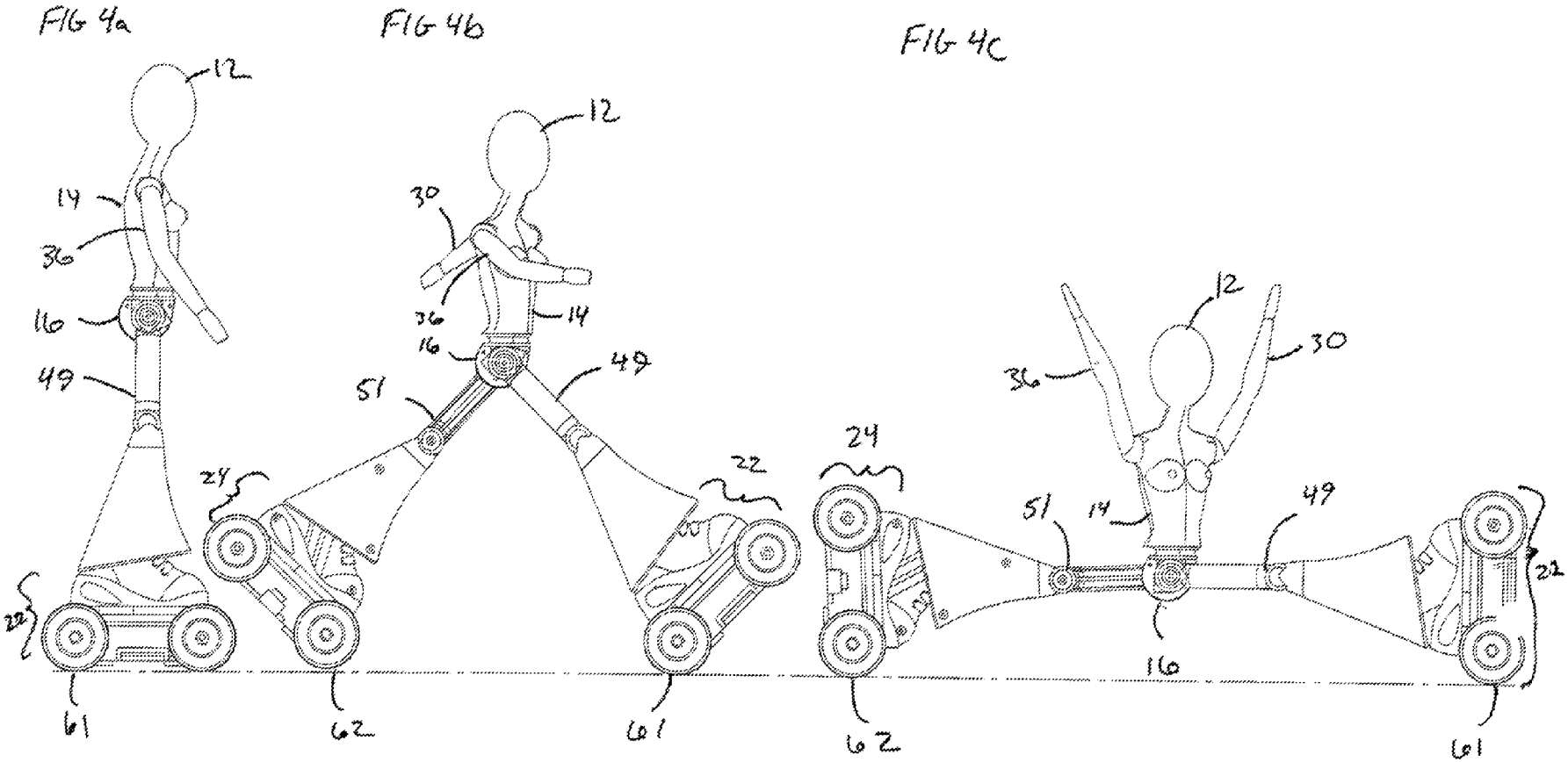
FIG. 4*a* shows a side view of a figure from FIG. 2*a* in a vertical position.
FIG. 4*b* shows a side view of a figure from FIG. 2*a* in a position in between a vertical position and a splits position.
FIG. 4*c* shows a side view of a figure from FIG. 2*a* in a splits position.
Figures 5A, 5B, 5C:
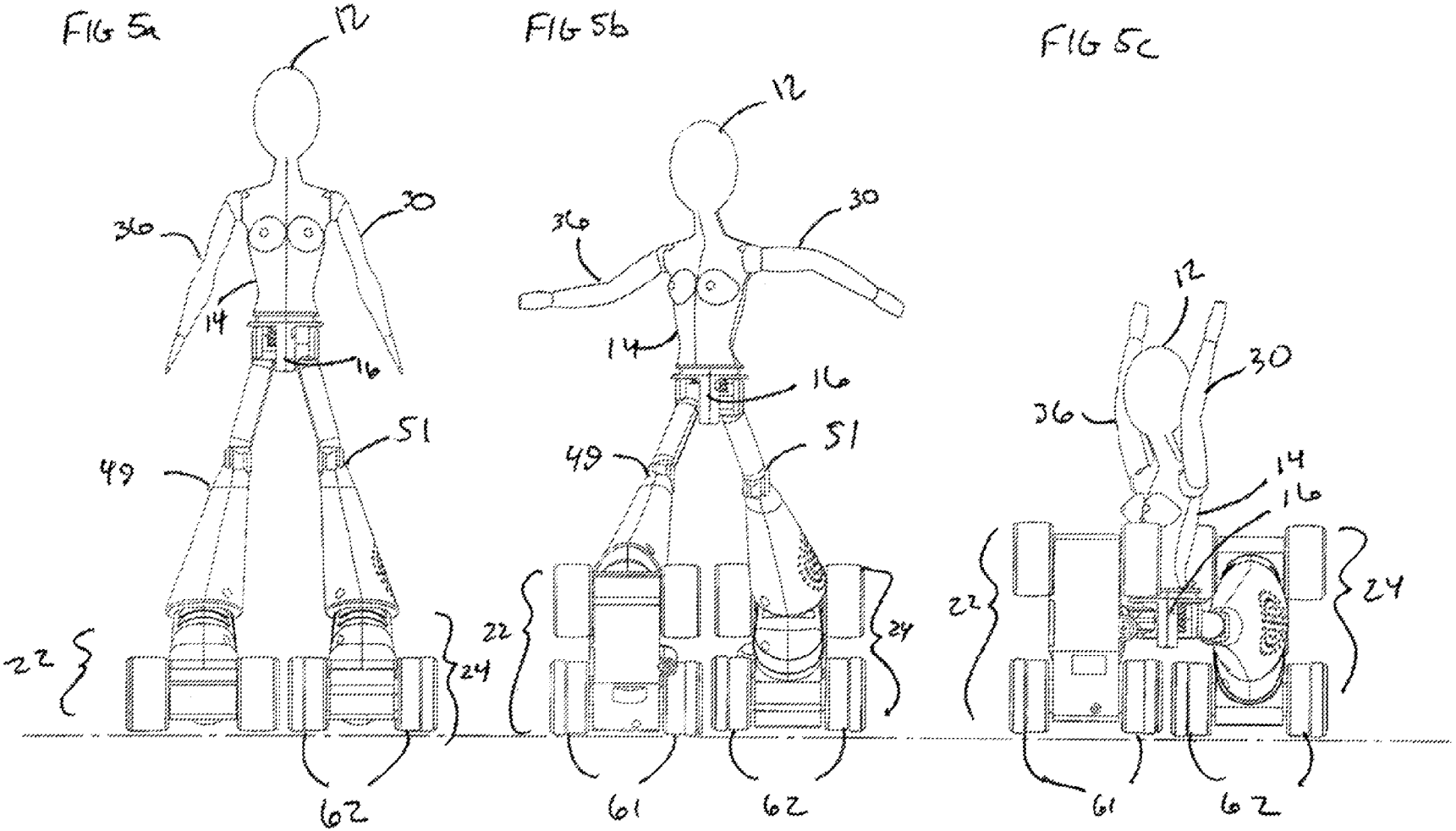
FIG. 5*a* shows a front view of a figure from FIG. 2*a* in a vertical position.
FIG. 5*b* shows a front view of a figure from FIG. 2*a* in a position in between a vertical position and a splits position.
FIG. 5*c* shows a front view of a figure from FIG. 2*a* in a splits position.

Referring now to FIGS. 4*a*-4*c* and 5*a*-5*c*, in this first embodiment, the interactive figure 10 also includes a means to drop to a "splits" position (or other positions with the legs moved in opposite directions) while simultaneously moving the torso cavity and arms. By directing the motorized wheelbases to power in opposite directions, the interactive figure drops to a splits position as seen in FIGS. 4*c* and 5*c*. The first motor 54 and second motor 58 drive the right leg 49 and left leg 51 to move out in a scissor-like manner. As the right leg 49 and left leg 51 move, the right bevel gear 48 and left bevel gear 50 transfer movement to the body bevel gear 44, the body axle 42 and the crown gear 38. The crown gear 38 simultaneously directs the right shoulder pinion 32 and left shoulder pinion 26 to move the right and left arms up and down. (It is noted that actual movement of the arms is made by arcing the right arm forwards and upwards until it is pointing straight up while the left arm is arcing backwards and upwards.) As such, when the motorized wheelbases are powered in opposite directions, the legs spread apart while the torso cavity twists and the arms simultaneously move up and down.

While in the splits position, the right powered wheels 61 and left powered wheels 62 included in the motorized wheelbases remain in contact with the surface. Thus, the interactive figure 10 can move on a surface while maintaining the splits position. Further, by reversing the direction of power to the motorized wheelbases, the right leg 49 and left leg 51 move from the splits position back to their respective vertical positions. By distributing power to each of the motorized wheelbases, a user is able to utilize the controller to direct the interactive figure 10 to move from the vertical standing position to the splits position and back up to the vertical standing position as desired.

Figure 6:
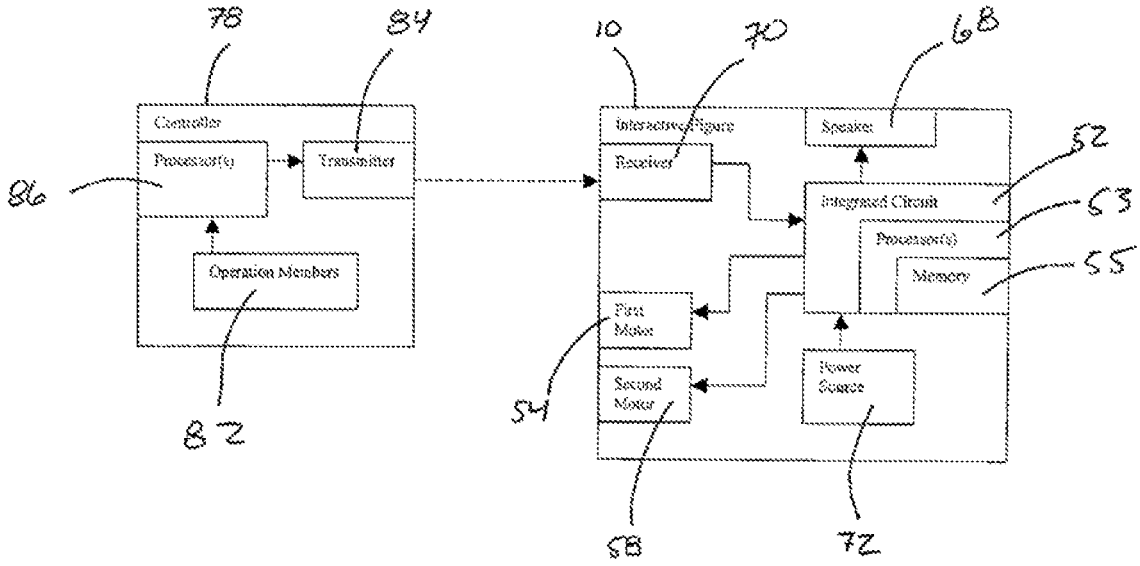
FIG. 6 is a block diagram of an interactive figure for an embodiment in accordance with the invention.

Referring now to FIG. 6, there is shown a block diagram provided for the first embodiment of the interactive figure 10.

The interactive figure 10 includes an IC 52 that contains a processor(s) 53 and a memory 55. The processor(s) 53 accesses preprogrammed signals or audio content stored on the memory 55 in the IC 52. The IC 52 further includes programming and electronic components to facilitate and direct audio content, control signals, and data. The processor (s) 53 in the IC 52 accesses the preprogrammed signals or audio content based on a program and/or in accordance to a user's input. The processor(s) 55 than generates a response that includes signals and may be in the form of audio or control signals. The IC 52 is in communication with a speaker 68, a receiver 70, a first motor 54, a second motor 58, and a power source 72. A controller 78 would contain components well known in the art to facilitate remote control capabilities. For example and as illustrated in FIG. 6, the controller 78 may include a plurality of operation members 82, a transmitter 84 and a processor(s) 86. The transmitter 84 is in communication with the receiver 70 positioned in the interactive figure 10. The IC 52 receives a user's input from the plurality of operation members 82 transferred through the aforementioned communication stream. From the processor(s) 53 audio signals are transferred to the speaker 68 while control signals are transferred to the first motor 54 and the second motor 58 to direct the motors to power in a desired direction, based on a program and/or in accordance to a user's input or preprogrammed response. As such, a user can selectively distribute power to the motorized wheelbases to direct the interactive figure 10 to move on a surface. Further, as the motorized wheelbases move, the movement is transferred throughout the interactive figure 10. This is accomplished through the gear mechanism as described above.

It should further be contemplated that the interactive figure 10 can include audio content and preprogrammed responses stored in the IC 52. The user may press a power button (or other triggering mechanism) to trigger the preprogrammed responses and audio content stored on the memory 55. The interactive figure 10 in response can execute a performance pattern through movement and audio.

From the foregoing and as mentioned above, it will be observed that numerous variations and modifications may be effected without departing from the spirit and scope of the novel concept of the invention. It is to be understood that no limitation with respect to the specific methods and apparatus illustrated herein is intended or should be inferred.

I claim:

1. A motorized interactive figure comprising:

a lower torso bevel gear assembly including a lower body bevel gear meshed to a lower left bevel gear and meshed to a lower right bevel gear;

a left leg being mechanically linked to the lower left bevel gear and a right leg being mechanically linked to the lower right bevel gear, wherein movement of either the left leg or right leg moves the right leg or left leg respectively in an opposite direction;

a first position defined by the substantially vertical positioning of the left leg and right leg;

a motorized wheelbase connected to the end of each of said left leg and right leg, each motorized wheelbase containing a motor mechanism for driving at least one set of wheels;

means to control the motor mechanisms based on preprogrammed signals, input signals, and/or audio content; and a processor that facilitates an operation of programs and access of data and content stored on a memory; wherein the processor facilitates a first transition movement from the first position by directing the motor mechanisms to power in opposite directions, such that the motorized wheelbases move in opposite directions as the left leg and right leg pivot outward at the lower torso bevel gear assembly to define a splits position where the left leg and right leg are substantially horizontal relative to a surface and the at least one set of wheels in each motorized wheelbase remains in contact with the surface throughout the first transition movement;

wherein the processor facilitates a second transition movement by directing the motor mechanisms to power and move the motorized wheelbases toward one another, pivoting the left leg and right leg inward at the lower torso bevel gear assembly to return the figure to the substantially upright position and the at least one set of wheels in each motorized wheelbase remains in contact with the surface throughout the second transition movement.

2. The figure of claim 1 further comprising:

a body axle having one end secured to the lower body bevel gear defined in the lower torso bevel gear assembly;

an upper torso bevel gear assembly having an upper body bevel gear meshed to an upper left bevel gear and meshed to an upper right bevel gear, the upper body bevel gear being secured to the opposite end of the body axle, such that rotation of the lower body bevel gear causes rotating of the upper right bevel gear and visa versa; and a left arm being mechanically linked to the upper left bevel gear and a right arm being mechanically linked to the upper right bevel gear, wherein movement of upper body bevel gear causes movement in the left and right arms.

3. The figure of claim 1, wherein the first transition movement directs the upper torso bevel gear assembly to moves the left and right arms to an upward position.

4. The figure of claim 1, said figure further including a communication means to facilitate the transfer of input signals to said processor, said communication means including a wireless transmitter in a controller and a wireless receiver in said figure where said wireless receiver is in further communication with said processor.

5. The figure of claim 4, wherein said controller sends input signals to the processor via the transmitter and receiver to adjust the speed and direction of the motor mechanisms to control movement of the motorized wheelbases.

6. The motorized interactive figure of claim 1, said figure further including rings on one or more of the wheels where the rings are a material having increased frictional characteristics to adjust performance of the motorized wheelbases when moving.

* * * * *